US010844603B2

(12) United States Patent
Egan

(10) Patent No.: US 10,844,603 B2
(45) Date of Patent: Nov. 24, 2020

(54) ROOF DECK ASSEMBLY AND METHOD

(71) Applicant: Pro Fastening Systems, Inc., Arlington Heights, IL (US)

(72) Inventor: Donal H. Egan, Inverness, IL (US)

(73) Assignee: Pro Fastening Systems, Inc., Arlington Heights, IL (US)

( * ) Notice: Subject to any disclaimer, the term of this patent is extended or adjusted under 35 U.S.C. 154(b) by 0 days.

(21) Appl. No.: 16/668,674

(22) Filed: Oct. 30, 2019

(65) Prior Publication Data

US 2020/0131774 A1 Apr. 30, 2020

Related U.S. Application Data

(60) Provisional application No. 62/752,734, filed on Oct. 30, 2018.

(51) Int. Cl.
*E04D 13/14* (2006.01)
*E04D 5/14* (2006.01)
*E04D 5/06* (2006.01)

(52) U.S. Cl.
CPC ..... *E04D 5/146* (2013.01); *E04D 5/06* (2013.01); *E04D 5/142* (2013.01); *E04D 13/1407* (2013.01)

(58) Field of Classification Search
CPC ..... E04D 5/141; E04D 5/142; E04D 5/146; E04D 5/148; E04D 5/06; E04D 5/14; E04D 13/1407; E04D 13/1415; E04D 13/155; E04D 13/1478
USPC ..... 52/58, 506.05, 287.1
See application file for complete search history.

(56) References Cited

U.S. PATENT DOCUMENTS 364,304 A * 6/1887 Sagendorph ..... E04D 13/1415 52/58
1,694,521 A * 12/1928 Tucker ..... E04D 13/1415 52/58
2,222,868 A * 11/1940 Hollister ..... E04D 5/10 52/420
3,304,667 A * 2/1967 Donegan ..... E04D 13/1415 52/60
3,541,745 A * 11/1970 Probst ..... E04D 15/025 52/105

(Continued)

OTHER PUBLICATIONS

GSSI Sealants; MB-10A Sealant Tape; www.gssisealants.com; Dec. 14, 2015; 2 pgs.

(Continued)

*Primary Examiner* — Kyle J. Walraed-Sullivan
(74) *Attorney, Agent, or Firm* — Mark W. Croll

(57) ABSTRACT

The invention provides a generally horizontal roof deck having a corner and two parapet walls meeting at the corner. A roofing membrane has a major portion adhered to the roof deck and a side portion adhered to the first parapet wall and an end portion adhered to the second parapet wall. A bead of caulk is located between the side portion and the end portion and a respective parapet wall. Termination bars are affixed to the each of the parapet walls by axially driven pins that capture the termination bars on top of the respective side or end portions along their upper edges. Also disclosed is a method for constructing a roof deck using termination bars and axially driven pins that do not require predrilled holes.

16 Claims, 5 Drawing Sheets

(56) References Cited

U.S. PATENT DOCUMENTS 4,603,517 A * 8/1986 Lyons, Jr. ..... E04D 13/1407 52/219
4,635,409 A * 1/1987 Vandemore ..... E04D 13/1407 138/159
4,655,009 A * 4/1987 DeGraan ..... E04D 13/1415 52/467
4,691,891 A 9/1987 Dionne
4,700,512 A * 10/1987 Laska ..... E04D 13/1407 52/287.1
4,799,986 A * 1/1989 Janni ..... B29C 65/02 156/196
4,969,250 A * 11/1990 Hickman ..... E04D 3/405 228/142
4,996,801 A * 3/1991 Ristow ..... E04D 5/142 52/273
5,014,486 A 5/1991 Mayle
5,309,685 A * 5/1994 Rathgeber ..... E04D 5/142 428/189
5,319,908 A 6/1994 Van Erden et al.
5,497,596 A * 3/1996 Zatkulak ..... E04B 1/70 52/408
5,593,748 A * 1/1997 Hubbard ..... C09J 7/04 428/343
5,706,610 A * 1/1998 Mayle ..... E04D 13/02 285/42
5,711,116 A * 1/1998 Hasan ..... E04D 5/142 428/189
5,914,173 A * 6/1999 Fishel ..... A47K 3/002 428/156
6,070,370 A * 6/2000 Locke ..... E04D 13/1407 52/287.1
6,108,981 A * 8/2000 Sama ..... E04D 13/1415 52/58
6,199,326 B1 * 3/2001 Mayle ..... E04D 13/1407 52/287.1
6,401,402 B1 * 6/2002 Williams ..... E06B 1/62 49/471
6,449,910 B1 * 9/2002 Budd ..... E04D 13/0459 52/302.6
6,681,530 B1 * 1/2004 Givens ..... E04D 13/1407 108/16
6,754,993 B1 * 6/2004 Mayle ..... E04D 3/38 52/287.1
7,373,729 B2 * 5/2008 Mossot ..... E04F 19/0486 33/527
8,322,101 B2 12/2012 Kelly
9,127,460 B2 9/2015 Barksdale et al.
9,151,039 B2 * 10/2015 Fechino ..... E04B 1/7038
10,487,472 B2 * 11/2019 McPherson ..... E04B 1/7023
2003/0208964 A1 * 11/2003 Batt, Sr. ..... E04D 13/1475 52/11
2005/0055890 A1 * 3/2005 Summy ..... E06B 1/62 52/58
2005/0126103 A1 * 6/2005 Scheirer ..... E04D 5/12 52/518
2005/0268561 A1 * 12/2005 Lane ..... E04D 13/1475 52/58
2006/0053699 A1 * 3/2006 Lolley ..... E04B 1/66 52/58
2006/0123713 A1 * 6/2006 Faurholdt ..... E04D 13/1475 52/58
2009/0090068 A1 * 4/2009 O'rourke ..... E06B 1/62 52/58
2009/0282765 A1 * 11/2009 Finnerty ..... E04F 15/18 52/411
2010/0175342 A1 * 7/2010 Railkar ..... E04D 13/1475 52/514
2011/0056620 A1 * 3/2011 Barksdale ..... B32B 27/304 156/247
2011/0107685 A1 * 5/2011 Hasan ..... E04D 13/155 52/58
2012/0096787 A1 * 4/2012 Marcus ..... E04F 19/0486 52/287.1
2012/0151870 A1 * 6/2012 Summy ..... E04F 21/0038 52/741.4
2012/0180402 A1 * 7/2012 Kalwara ..... E04D 13/1407 52/58
2012/0204508 A1 * 8/2012 Kalwara ..... B32B 27/16 52/309.3
2012/0216474 A1 * 8/2012 Railkar ..... E04D 13/1407 52/302.6
2014/0134373 A1 * 5/2014 Kalwara ..... B32B 27/06 428/41.8
2014/0165478 A1 * 6/2014 Railkar ..... E04D 13/00 52/58
2015/0176282 A1 * 6/2015 Baker ..... E04D 12/002 52/716.2
2016/0010336 A1 * 1/2016 Kelly ..... E04D 5/00 52/408
2017/0314275 A1 * 11/2017 Rosenthal ..... B29C 48/21

OTHER PUBLICATIONS

Altenloh, Brinck & Co. U.S., Inc.; Trufast, Termination and Drain Bars; www.trufast.com; Jun. 2014; 2 pgs.
ADCO Roofing Products; Millennium Water Block Mastic (BP-300); www.adcocorp.com; 2 pgs.
GenFlex Roofing Systems; EZ TPO Systems, Two-Piece Inside Corner; Oct. 26, 2015; 1 pg.

* cited by examiner

ROOF DECK ASSEMBLY AND METHOD

CROSS REFERENCES TO RELATED APPLICATIONS

The present application for patent claims the benefit of U.S. Provisional Patent Application No. 62/752,734, filed Oct. 30, 2018, the disclosure of which is incorporated herein by reference in its entirety.

FIELD OF THE INVENTION

The present disclosure relates in general to horizontal roof deck assemblies and methods for constructing those assemblies.

BACKGROUND OF THE INVENTION

A current method of securing membrane to the vertical parapet walls generally surrounding a flat roof deck entails the steps of:

1. Put a horizontal bead of Water Block caulk or mastic along the roof deck exterior or parapet wall about a foot above the roof deck behind the membrane and roll the membrane up the wall contacting the caulk.
2. Place a 10' length of termination bar having pre-drilled holes every 6 inches up to desired position and mark the holes, generally every other hole, where the installer will want to install Zamac nail-in anchors.
3. Set the termination bar aside.
4. Drill holes at least 1½" deep using a hammer drill and SDS concrete drill bit.
5. Retrieve the 10' length of termination bar and place it up against the membrane insert a Zamac Anchor in the hole near the center of the bar and pound in the Zamac Anchor into the pre-drilled hole using a hammer.
6. Repeat installing Zamac anchors every other hole to achieve 12" on center (typical fastening pattern is every 12").
7. Add a bead of sealant across the top of the termination bar or top of the membrane to assist in keeping water from penetrating the back of the bar.

As can be appreciated the current method generally requires at least two persons working in concert to hold up a 10 foot long aluminum termination bar, mark the holes, retrieve the bar, again hold it in the correct position and pound in Zamac anchors into pre-drilled holes. Even with at least two installers, the current method is relatively slow to construct a roof. The Water Block caulk must be handled twice and beads laid down in two separate locations. The long aluminum termination bar must also be handled twice, once for marking the holes to be drilled and a second time while Zamac anchors are being pounded through its holes. In addition, drilling 1½" deep holes using a hammer drill and SDS concrete drill bit into concrete or masonry can be very time consuming and creates extensive dust, often potentially harmful silica dust. Moreover, one slip in handling the termination bar during the measuring step and all of the holes may be in the wrong location requiring re-drilling.

U.S. Patent Publication No. 2011/0107685 discloses a termination bar with an adhesive backing for temporarily attaching the bar to flashing placed against a parapet wall.

SUMMARY OF THE INVENTION

The current invention uses a termination bar that is attached to the parapet wall by means of pins axially driven through the termination bar and into the wall, preferably with a gas powered tool, such as a Ramset T3SS tool. The improved method replaces the standard method of using an aluminum termination bar to align holes, drilling the holes, realigning the bar with the holes, inserting a Zamac nail-in anchor in each hole, and pounding them in with a hammer.

The invention provides a method of securing a roll of roofing membrane to a roof deck having a pair of parapet or side walls terminating in a corner. The membrane has a side portion that extends up one parapet wall and an end portion that extends up the second parapet wall. The major portion of the membrane is adhered to the roof deck, and the side and end portions are adhered to the first and second parapet walls. Elongate termination bars are secured to the top surfaces of the membrane side portion and end portion in a single step by driving axially driven pins through the termination bars, the membrane and into the parapet wall.

In one embodiment, a slit is cut into the membrane at the corner for creating a corner seam. In one embodiment, a flap formed at the corner by the slit is adhered to a corner portion of one of the side portion or end portion. In another embodiment, a pig ear folded corner creates a flap and the flap is adhered to the side portion or end portion before securing the termination bars. In one embodiment, the method includes placing a bead of caulking between the backsides of the side portion and the end portion and their respective parapet walls prior to securing the termination bars.

The invention provides a generally horizontal roof deck assembly having a corner and two parapet walls meeting at the corner. A roofing membrane has a major portion adhered to the roof deck and a side portion adhered to the first parapet wall and an end portion adhered to the second parapet wall. A bead of caulk is located between the side portion and the end portion and a respective parapet wall. Termination bars are affixed to the each of the parapet walls by axially driven pins that capture the termination bars on top of the respective side or end portions along their upper edges.

In one embodiment, the pins have heads, points and smooth shanks and are made of hardened steel. In one embodiment, the termination bars have a sealant layer on their backsides and the pins are driven though the sealant layer also.

The inventive assembly and method save installers both time and effort. The bead of Water Block caulk above the bar may be optional in the method, as the sealant backed termination bar may provide the necessary water impermeability. Moreover, no drilling is necessary, since the axially driven concrete pins will hold the bar and thus the assembly in place. With a T3 Gas tool from ITW Ramset and complementary pins, the installation time can be up to eight times faster than the current method. In addition, with no drilling there is considerably less potentially harmful silica dust in the workplace environment. The sealant backed termination bar allows the bar to be temporarily placed into position while the installer gathers the tool and fasteners to complete the installation. Even without the sealant backing on the termination bar, the bar can be held in place by the installer while driving the pins. In either case, a step is eliminated. In addition, the coated pins allow for improved corrosion resistance.

DESCRIPTION OF A PREFERRED EMBODIMENT

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration may be used herein to refer to a specified arrangement, or a structural size and shape.

Figure 1:
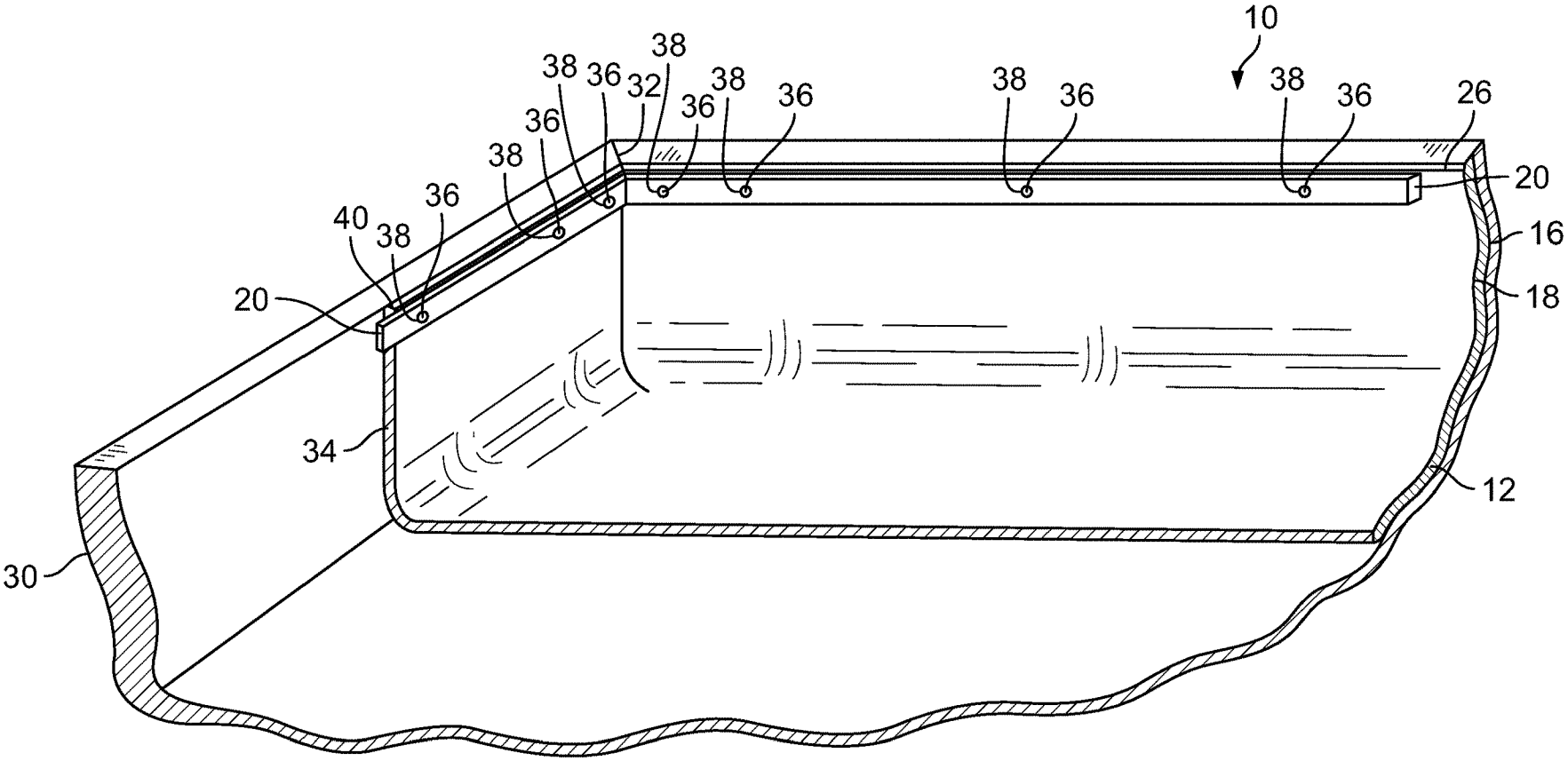
FIG. 1 is a perspective view of a portion of a roof deck assembly of the invention.

FIG. 1 shows a portion of a roof deck assembly with the inventive structure. Adhered to the base or substrate of the generally horizontal or flat roof are long sheets of thermoplastic membrane 12 that are originally placed on the roof deck substrate in a roll and rolled out. The terms horizontal or flat roof in this context also include a roof with a slight pitch, provided it is appropriate to be covered and sealed with a membrane covering. Commonly, each sheet of the membrane is 8 or 10 feet wide and 100 feet long. In order to cover a large roof, various sheets can be placed side by side and connected with overlapping seams. The membrane is preferably made of a thermoplastic such as EPDM, TPO or PVC and is manufactured and sold by various companies such as Firestone, Carlisle or Sarnafil.

Figure 5A:
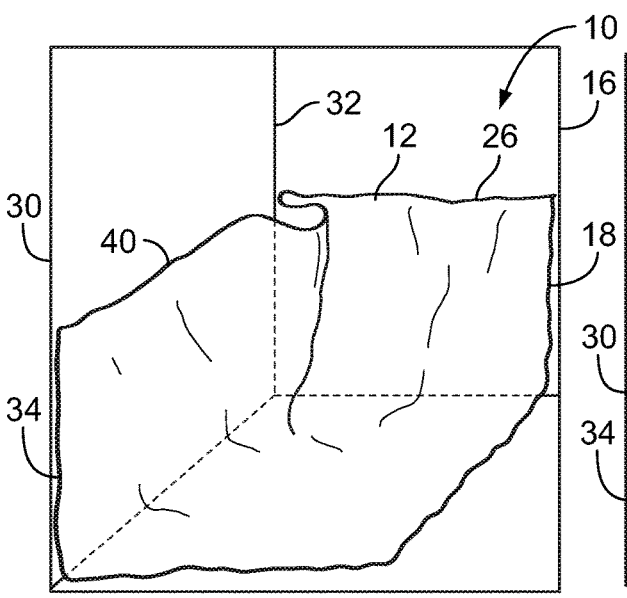
FIGS. 5*a*-5*d* are perspective views of a stylized roof deck assembly showing various steps during construction of one embodiment of the invention.

Along at least one side of the roof deck is a first sidewall, such as a parapet wall 16 that extends upwardly vertically from the roof deck. In one embodiment, the parapet wall extends approximately 24 inches above the roof deck. The wall may be concrete or composite block or poured-in-place concrete. A side portion 18 of the membrane 12 is laid up against the inside surface of the parapet wall 16 as shown in FIGS. 1 and 5*a*. In a preferred embodiment, the side portion is approximately or slightly less than 24 inches wide so that the top edge 26 of the membrane is coplanar or even more preferably slightly below the top of the first parapet wall 16.

FIGS. 1 and 5 also show a second sidewall 30 such as a parapet wall normal to the first parapet wall 16 and meeting the first parapet wall at a corner 32 An end portion 34 of the membrane sheet 12 extends upwardly from the junction of the roof deck substrate and the second parapet wall so that the top edge 40 of the end portion 34 is coplanar or more preferably slightly below the top of the second parapet wall 30.

In one embodiment, a bead 24 of water block caulking or mastic is run in a generally horizontal line along the front face of the first parapet wall. The caulking will lie between the backside of the upper portion of the side portion 18 and the face of the first parapet wall 16 at a location immediately below the top edge 26 and behind the termination bar 20, when the side portion is pressed onto the first parapet wall and into the caulking 24. In similar manner, a second bead 42 of water block caulking or mastic is run in a generally horizontal line along the front face of the second parapet wall 30 at a location immediately below the top edge 40 and behind the termination bar 20. The caulking will be between the backside of the upper portion of the end portion 34 and the face of the second parapet wall 30 when the end portion is pressed onto the second parapet wall and into the caulking 42. One suitable caulk is Millennium Water Block Mastic (BP-300) sold by ADCO Roofing Products. This may enhance the water impenetrability between the backside of the membrane 12 and the surface of the parapet walls 16 and 30. In a further optional embodiment, another bead of water block may be run along the top edges 26 and 40 of the side portion 18 and end portion 34 and walls 16 and 30 respectively. Counterflashing, coping or a cover tape may also be used to enhance the water impenetrability of this top edge behind side portion 18 and end portion 34 of the membrane 12.

Termination bars 20 are secured onto the front side of the side portion 18 and end portion 34 of the membrane 12 at locations just below the top edges 26 and 40. The termination bars 20 are generally made of aluminum and are commonly 10 feet long and approximately an inch wide. In some embodiments, termination bars can be between 0.075" and 0.090" thick and have a constant cross section. In other embodiments, they may have an outwardly extending flange along the top, bottom or both edges to create 'L' or 'U' shaped cross sections to enhance their rigidity. In one embodiment, holes, or apertures are pre-drilled in the termination bars 20 every 6 or 8 inches along the length. The holes may be ¼" round or may be ¼" by ⅜" slotted holes. Trufast® termination bars sold by Altenloh, Brinck & Co. may be used in these embodiments. Alternatively, termination bars without holes may be used in other embodiments of this invention. The termination bars 20 without holes may have markings on their front sides every 6 or 8 inches for indication to the installer of where pins should be driven to install the termination bar 20. In other embodiments, the termination bars 20 will have no apertures and no markings on the front side and it is left up to the discretion of the installer to determine the proper spacing of the pins.

In one embodiment, the backside of the termination bars 20 has a sealant layer 28 (see FIG. 3) attached thereto. In one embodiment, the sealant layer 28 on the termination bar is a butyl rubber tape also approximately an inch wide. The butyl rubber tape also has a backing tape, made of coated paper for transport of the termination bar 20 with the sealant layer 28 to the job site. One suitable butyl rubber sealant is MB-10A Sealant Tape sold by GSSI Sealants. In termination bars with pre-drilled holes, the sealant layer may also be pre-drilled, or it may be continuous along the backside and thus cover up the backside of each hole.

In constructing the generally water impermeable roof deck, the side portion 18 and the end portion 34 of the membrane 12 are initially pressed against the respective parapet wall 16 and 30, and into a bead of water block caulking. Next, a collinear series of termination bars 20 is set proximate or just below the top edge 26 of the side portion and top edge 40 of the end portion 34. In one embodiment, each termination bar is initially held in position by an installer's hand or by pressing a driving gun 50 against the front face of the termination bar near a location approximately equidistant from each end. With this center point of the termination bar in position, an axial pin 36 is driven by the driving gun through the termination bar, the membrane and caulk and into the parapet wall without needing to drill a hole. With the approximate center of the termination bar at the proper height with respect to the top edges 26 and 40 of the membrane, the termination bar 20 can be leveled and other pins driven into the bar working outwardly in both directions so that the bar is at the proper height, generally proximate the top of the membrane along its entire length.

In one embodiment, the termination bar has a sealant layer on its backside. After the backing tape is removed from the sealant layer on the backside of each termination bar 20. The sealant layer temporarily adheres the termination bar 20 to the side portion 18 and end portion 34 of the membrane 12 so the termination bar can be located without the need of an installer to hold it in place. Once a termination bar 20 is properly located, pins 36 are driven through the termination bar 20 and into the parapet wall to securely attach the termination bar 20 and thus the membrane to the parapet wall 16. In a preferred embodiment, similar to the embodiment with no sealant layer, for each termination bar 20, a pin 36 is initially driven near the center of the bar and subsequent pins are driven to the left and right of the center, for example every 6", 8" or 12" depending on the installation preference. In addition, since holes in the termination bar are not necessary, pins 36 can be driven closer to each other in higher stressed areas, such as near corners. See FIG. 1.

In either embodiment, the termination bar 20 is only handled once by the installer. Each bar 20 is located and secured to the membrane and parapet wall without being moved. This is in sharp contrast with the current prevailing method that requires using the termination bar as a template to locate prospective boreholes, removing the bar, drilling the boreholes and then repositioning the bar for its ultimate attachment with fasteners in the predrilled boreholes. In either inventive embodiment, the top edge of the termination bar can be co-planar with the top edges 26 and 40 or slightly below the top edges 26 and 40. In either embodiment, additional beads of water block caulking may be placed along the top of the termination bar 20 and top edge 26 to enhance water impenetrability.

Axially driven pins 36, preferably of hardened steel with smooth shanks and washers 38 and corrosion resistant coating, are driven through the termination bar 20 to securely attach the bars 20 to the parapet wall 16 and sandwich the side and end portions 18 and 34 of the membrane 12, thus also holding the side portion 18 to the wall 16. The pins can be driven through the pre-drilled holes in termination bars having holes, or they can be driven directly through termination bars without holes. However, there is no need for drilling boreholes into the parapet walls, as the axially driven pins will provide sufficient holding power when being axially driven into the parapet wall by the axial driver. In one preferred embodiment, a T3 combustion tool sold by ITW Ramset is used to drive a complementary 1", 1.125, or 1.25" smooth sided straight shank pin 36 with washer 38 and Climaseal weather resistant coating. In other embodiments, powder actuated tools or electrically actuated axial driver tools may be used to drive complementary corrosion resistant pins, such as pins made by Powers with Permaseal coating or those made by Elco with Stalgard coating.

FIGS. 5*a-d* depict various steps of embodiments of methods of constructing a roof deck assembly 10 in accordance with the present invention. The initial roof deck comprises a substrate, a first upstanding parapet wall 16, and a second upstanding parapet wall 30 normal to the first parapet wall with the walls meeting and forming a corner 32. In FIG. 5*a*, a membrane 12 is rolled out so that the major portion of the membrane covers the roof deck substrate and a side portion 18 extends upwardly on the first parapet wall 16 and an end portion 34 of the membrane extends upwardly on the second parapet wall 30.

Figure 5B:
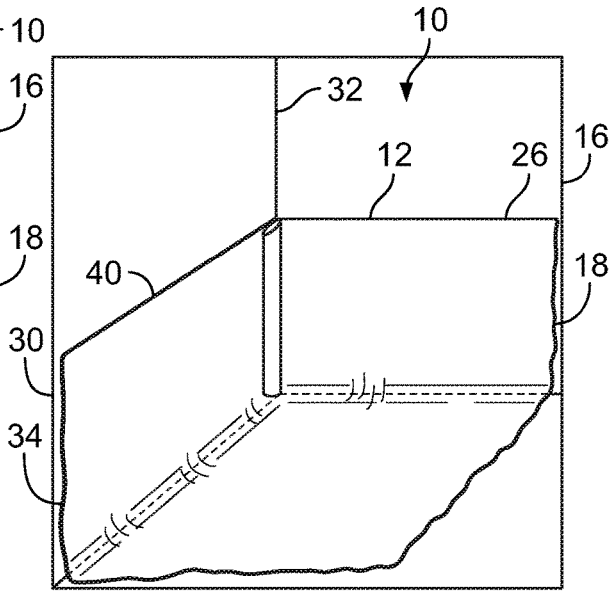

The membrane is folded over 44 at the corner 32 to accommodate the extra membrane material at the corner. In one embodiment, the fold is made without cutting the membrane to form what is generally referred to as a pig ear fold. The fold is rotated onto the one of the side portion or the end portion. In the case of FIG. 5*b*, the fold is rotated onto the end portion so that for a short length, the end portion 34 has a double or triple thickness. In the area of additional thickness, a separate termination bar 20 may be used. In FIG. 5, the side portion and the end portion are both of equal height. However, it can be appreciated that one of the side portion or the end portion may extend higher than the other.

In another embodiment a slit or cut-out is cut into the membrane at or near the corner to allow for other folding procedures that would have less or no (as in FIG. 1) membrane material folded over and thus less layers of membrane at the fold area. Additional caulking, heating of the membrane to fuse it, or corner reinforcements (not shown) may be applied to the membrane at the slit or cut-out and around any folds in the corner areas in order to reduce the chance of water penetration.

Figure 5C:
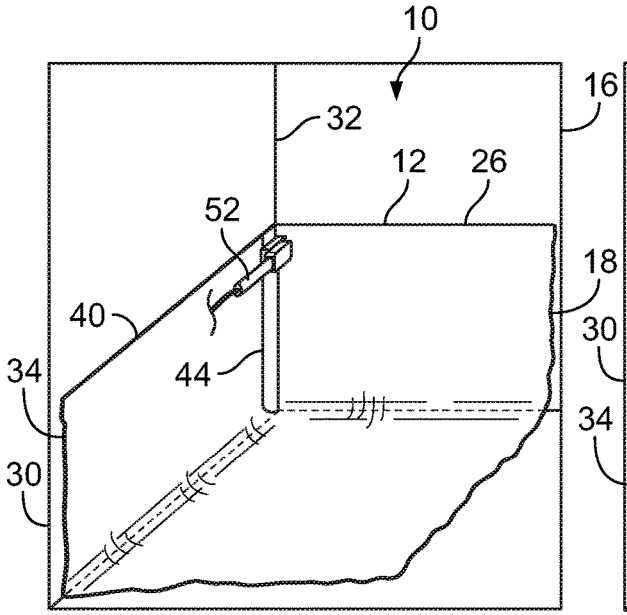

FIG. 5*c* shows heat being applied by a heat gun 52 to the fold 44 to adhere the fold to one of the side portion or the end portion, in this case the end portion. The heat also reduces the chances of water penetration between the layers of the fold. Caulking may be placed between the layers.

Figure 5D:
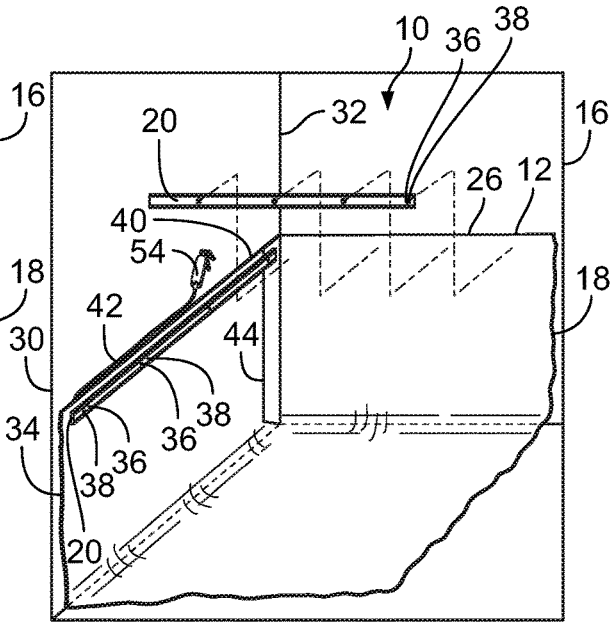

FIG. 5*d* shows the termination bar 20 for the end portion installed. Longer pins 36 may be needed in order to ensure that the pins fully penetrate the wall and the termination bar is securely fastened in the area of the rotated fold. Also shown in FIG. 5*d* is the prospective location of the termination bar for the side portion. A bead of caulk 42 is being laid along the top edge 40 of the end portion 34 or along the top of the termination bar 20 or both. It can be appreciated that caulk will also be laid along top edge 26 the side portion 16 or the top edge of the termination bar 20 after that termination bar has been installed.

Figure 2:
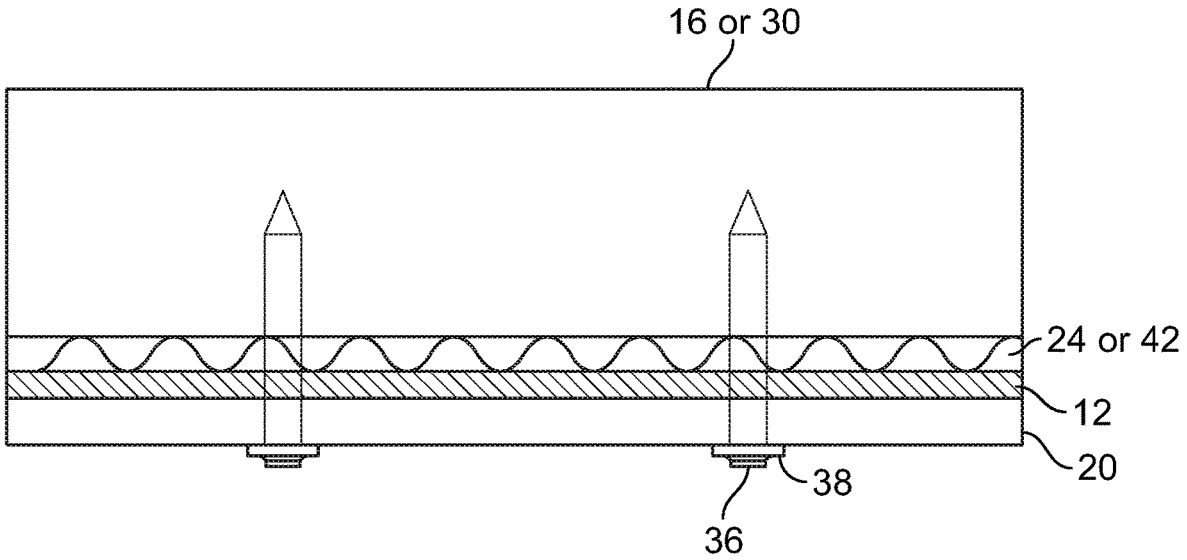
FIG. 2 is a stylized sectional view of parapet wall with membrane attached by one embodiment of the invention.
Figure 3:
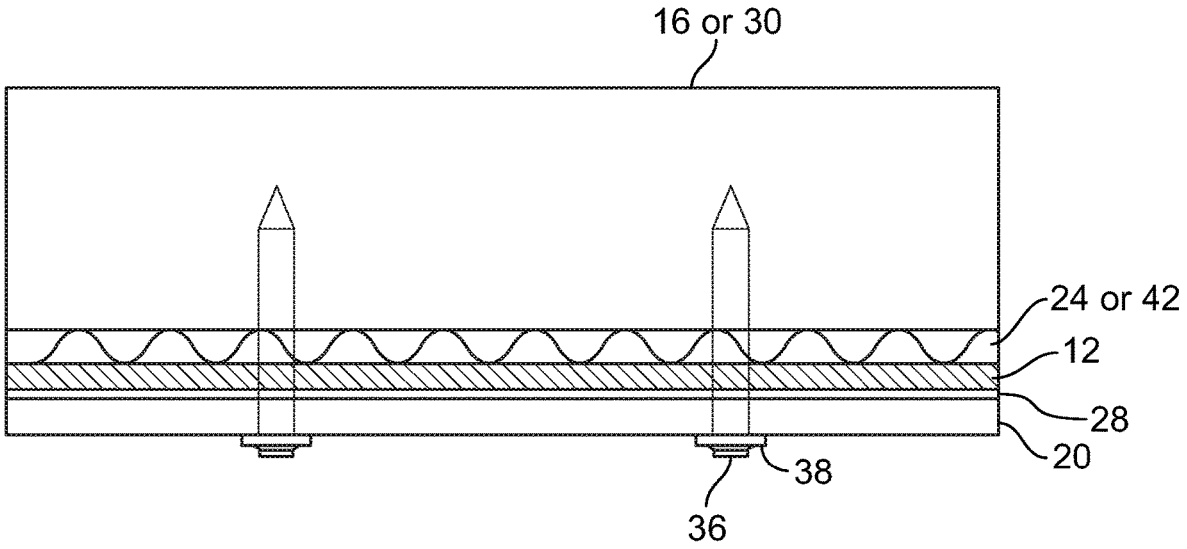
FIG. 3 is a stylized sectional view of a parapet wall with membrane attached by another embodiment of the invention.
Figure 4:
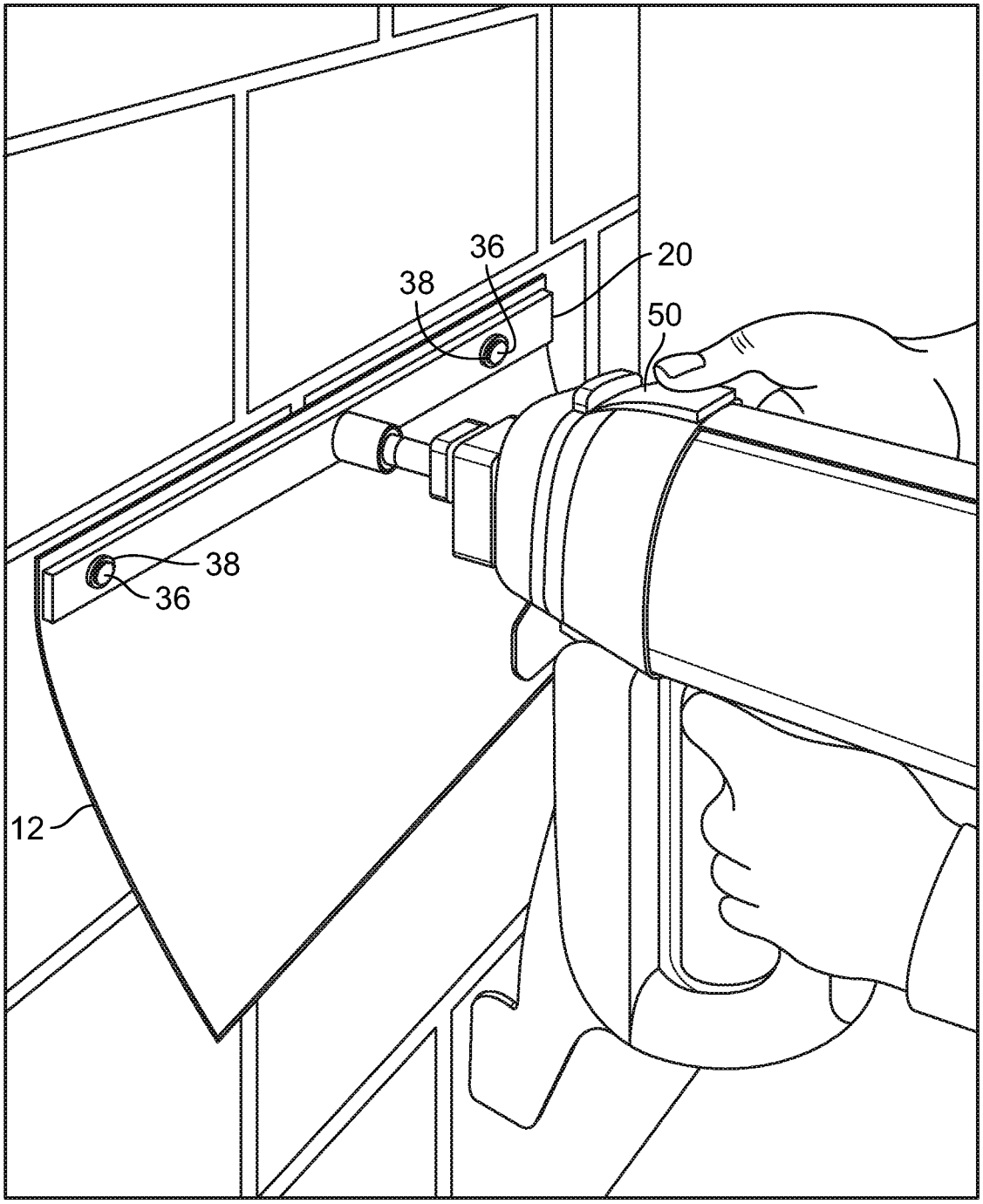
FIG. 4 is a drawing depicting a pin being driven through a termination bar by an ITW Ramset T3 tool.

As seen in FIG. 2, the head of the pin captures the washer 38 to hold the termination bar 20 against the membrane 20. In FIG. 3, the sealant layer 28 may be slightly extruded into and around the hole in the termination bar 20 to enhance the water impenetrability. In similar fashion, the water block 24 may also be extruded around the holes in the membrane 12 and the wall 16 to enhance the water impenetrability. FIG. 4 is a drawing of a pin 36 with a washer 38 being driven through a termination bar and membrane by an exemplary ITW Ramset T3 tool. A preferred location of the top of the termination bar to the top of the membrane is illustrated.

It can be appreciated that with the termination bar with the sealant layer attached, the bar can be temporarily mounted to the membrane during installation greatly reducing the amount of labor required to mount the termination bar. In addition, the axial driving of pins through the bar, or through holes in the bar is much easier and quicker than drilling holes in the wall and then pounding in Zamac fasteners.

In summary, in one embodiment, the invention provides a new roof deck assembly achieved through a new and novel method comprising the steps of:

1. Put a horizontal bead of Water Block caulk along the parapet wall approximately two feet above the roof deck and roll or slide the membrane up and onto the Water Block caulk is between the wall and the backside of the membrane.

2. Optionally, if using a termination bar with a sealant layer on its backside, remove the paper backing tape from the sealant layer attached to the backside of a length of termination bar.
3. Place the length of termination bar with sealant backing up to a desired position near the edge of the membrane along the parapet wall and stick it into place.
4. Using a tool that will axially drive a weather resistant coated pin into concrete or masonry, such as a Ramset T3 SS Gas Tool, fire one washered pin into the sealant backed termination bar near its center, or if it has predrilled holes, into the center hole.
5. Repeat axially driving pins along the termination bar generally somewhere between every 6" to 12" achieve the desired on center fastening pattern.
6. Optionally, add a bead of sealant across the top of the termination bar or top of the membrane or both to keep water from penetrating the back of the bar and the back of the membrane.

Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

I claim:

1. A method of securing a roll of roofing membrane having a length with an end portion and a width with a side portion to a substantially horizontal roof deck and to first and second vertical parapet walls meeting at a corner comprising;

rolling out the length of roofing membrane on the roof deck with one side portion of the roofing membrane extending upwardly so a bottom surface of the side portion abuts an inner surface of the first parapet wall, and a bottom surface of one end portion of the roofing membrane extending upwardly so the bottom surface of the one end portion abuts the inner surface of the second parapet wall, with the side portion and the end portion having an upper edge, adhering a major portion of the roofing membrane to the roof deck, the side portion to the first parapet wall and the end portion to the second parapet wall, securing a first elongate termination bar on a top surface of the side portion of the roofing membrane with a top edge of the first termination bar parallel to and proximate with the upper edge of the side portion of the roofing membrane by axially driving a plurality of pins through the first termination bar so that the pins extend through the first termination bar and side portion of the roofing membrane and are embedded into the first parapet wall, securing a second elongate termination bar on a top surface of the end portion of the roofing membrane with a top edge of the second termination bar parallel to and proximate with the upper edge of the end portion of the roofing membrane by axially driving a plurality of pins through the second termination bar so that the pins extend through the second termination bar and end portion of the roofing membrane and are embedded into the second parapet wall, and creating a pig ear fold by folding an outwardly extending portion of the side portion and the end portion of the roofing membrane at the corner and adhering the folded portion to the top surface of one of the side portion or the end portion of the roofing membrane before securing the first and second termination bars.

2. The method of claim 1 further comprising the step of placing a bead of caulking between a back side of the side portion and the first parapet wall and placing a bead of caulking between a back side of the end portion and the second parapet wall prior to securing the first and second termination bars to respective parapet walls.

3. The method of claim 1 wherein each termination bar has a rectangular cross section.

4. The method of claim 1 wherein each termination bar has an L shaped cross section.

5. The method of claim 1 wherein each termination bar comprises a front side and a back side and a sealant layer with backing tape on the back side, the method further comprising removing backing tape from the sealant layer on the back side of each termination bar prior to placing respective termination bars on the side portion and end portion.

6. The method of claim 1 wherein the first and second termination bars have a series of apertures spaced at even intervals along the lengths of the first and second termination bars.

7. The method of claim 1 also including the step of placing a bead of caulking along the top of the first and second termination bars after the first and second termination bars have been secured to respective parapet walls.

8. A roofing assembly comprising:

a generally horizontal roof deck having a corner;

a first parapet wall having an inner surface extending upwardly from one a first side of the roof deck; a second parapet wall having an inner surface extending upwardly from a second side of the roof deck normal to the first side of the roof deck and meeting the first parapet wall at the corner of the roof deck;

a thermoplastic roofing membrane having a major portion extending horizontally and adhered to the roof deck, with a side portion of the roofing membrane extending upwardly along the inner surface of the first parapet wall, said side portion having a top edge, and with an end portion of the roofing membrane extending upwardly along the inner surface of the second parapet wall, the end portion also having a top edge;

a horizontal bead of caulk between the inner surface of the first parapet wall and a bottom surface of the side portion immediately below a top edge of the side surface, and between the inner surface of the second parapet wall and the bottom surface of the end portion immediately below the top edge of the end portion;

a first elongate termination bar secured to a top surface of the side portion of the roofing membrane so the top edge of the first termination bar is parallel to and proximate with the top edge of the side portion of the roofing membrane by a plurality of axially driven steel pins through the first termination bar and side portion of the roofing membrane and into the first parapet wall; and a second elongate termination bar secured to a top surface of the end portion of the roofing membrane so the top edge of the second termination bar is parallel to and proximate with the top edge of the end portion of the roofing membrane by a plurality of axially driven steel pins through the second termination bar and end portion of the roofing membrane and into the second parapet wall; and wherein at the corner, a portion of one of the end portion or side portion of the roofing membrane is folded over onto the top surface of the end portion or side portion and adhered to the top surface of the end portion or side portion.

9. The roofing assembly of claim 8 wherein the plurality of axially driven steel pins have a head, a point and a shank.

10. The roofing assembly of claim 9 wherein the plurality of axially driven steel pins are made of hardened steel and are coated with a weather resistant coating.

11. The roofing assembly of claim 10 wherein the plurality of axially driven steel pins also have a washer under the head of each pin of the plurality of axially driven steel pins.

12. The roofing assembly of claim 8 wherein the first and second termination bars backsides have a sealant layer attached thereto and the plurality of axially driven steel pins are also driven through the sealant layer.

13. The roofing assembly of claim 8 also comprising a bead of caulking above the first and second termination bars.

14. The roofing assembly of claim 8 wherein the first and second termination bars have a rectangular cross section.

15. The roofing assembly of claim 8 wherein the first and second termination bars have an L shaped cross section.

16. The roofing assembly of claim 8 wherein the first and second termination bars have a series of apertures spaced at even intervals along the lengths of the first and second termination bars.

* * * * *